US006522844B2

(12) United States Patent
Yamane et al.

(10) Patent No.: US 6,522,844 B2
(45) Date of Patent: Feb. 18, 2003

(54) HEATER CONTROL APPARATUS AND IMAGE FORMING APPARATUS HAVING A PLURALITY OF HEATERS WHICH ARE CONTROLLED TO BE CHANGEABLY CONNECTED IN A SERIAL MODE AND A PARALLEL MODE SO AS TO SUPPRESS FLICKER

(75) Inventors: Hideo Yamane, Tokyo (JP); Youbao Peng, Tokyo (JP); Satoshi Sakata, Tokyo (JP); Hiroyuki Watanabe, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/906,273

(22) Filed: Jul. 16, 2001

(65) Prior Publication Data

US 2002/0012544 A1 Jan. 31, 2002

(30) Foreign Application Priority Data

Jul. 31, 2000 (JP) ..... 2000-231150

(51) Int. Cl.[7] ..... G03G 15/20

(52) U.S. Cl. ..... 399/67; 219/216; 219/501; 399/69

(58) Field of Search ..... 399/67, 69, 330, 399/331, 335, 336; 219/216, 501

(56) References Cited

U.S. PATENT DOCUMENTS 4,365,139 A * 12/1982 Dannatt ..... 399/335
5,669,038 A * 9/1997 Kishimoto ..... 399/67
6,097,905 A * 8/2000 Watanabe et al. ..... 399/69
6,157,010 A * 12/2000 Mine ..... 219/216 X
6,240,263 B1 * 5/2001 Watanabe et al. ..... 399/69
6,301,454 B1 * 10/2001 Nishida et al. ..... 399/69

FOREIGN PATENT DOCUMENTS

JP 10-55121 * 2/1998
JP 11-161101 * 6/1999
JP 2000-194237 * 7/2000

* cited by examiner

*Primary Examiner*—Fred L. Braun
(74) *Attorney, Agent, or Firm*—Frishauf, Holtz, Goodman & Chick, PC

(57) ABSTRACT

A heater control apparatus is provided for controlling a plurality of heaters used for fixing operations of an image forming apparatus, wherein each of the heaters is incorporated inside one of a plurality of rollers. The heater control apparatus includes: a plurality of switching elements to switch flowing paths of electronic currents supplied to the heaters from a common power source; a switching control section to control the switching elements so that a connecting mode of the heaters is changeable between a serial connection mode and a parallel connection mode; and a plurality of temperature detecting devices to detect temperatures of the rollers heated by the heaters, each of the temperature detecting devices corresponding to each of the rollers. The switching control section controls the switching elements so as to change the connecting mode of the heaters according to temperature conditions of the rollers.

4 Claims, 9 Drawing Sheets

SERIAL CONNECTION

PARALLEL CONNECTION

FIG. 8 ( a )
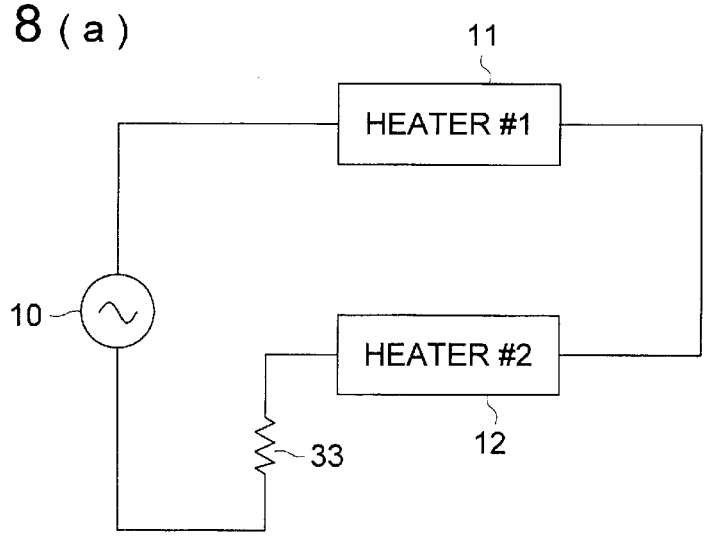
FIG. 8 ( b )
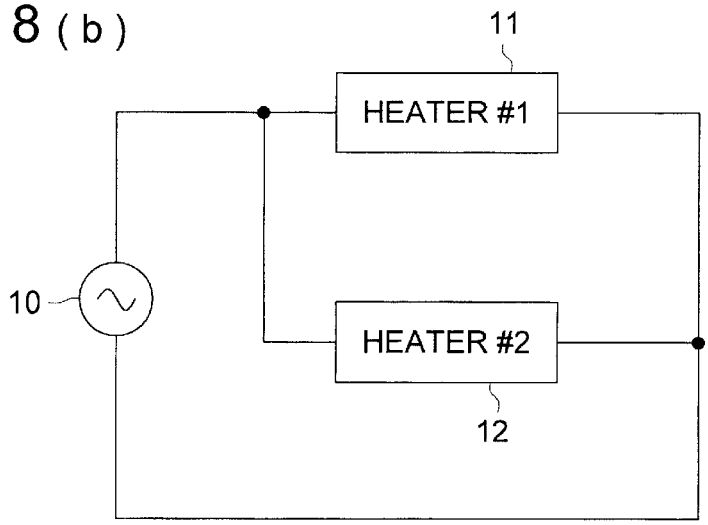
FIG. 8 ( c )
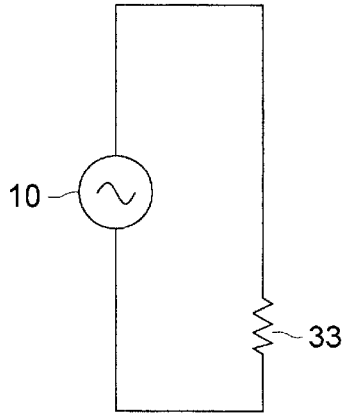

HEATER CONTROL APPARATUS AND IMAGE FORMING APPARATUS HAVING A PLURALITY OF HEATERS WHICH ARE CONTROLLED TO BE CHANGEABLY CONNECTED IN A SERIAL MODE AND A PARALLEL MODE SO AS TO SUPPRESS FLICKER

BACKGROUND OF THE INVENTION

The present invention relates to a heater control apparatus to control a heater as a heating source used for the fixing of an image forming apparatus, and to an image forming apparatus using this control apparatus. Generally, in an image forming apparatus which operates by an electrophotographic method, in order to thermally fix a toner image transferred onto one surface of an image supporter such as a transfer sheet, a fixing device is provided with a fixing heating roller contacted with one surface of the image supporter, and a pressure roller is arranged so as to be pressure contacted with the fixing heating roller.

Then, in a certain kind of fixing device, as the heating source of the fixing heating roller, for example, heater lamps such as a halogen lamp (hereinafter, simply called heater) are respectively provided in upper and lower rollers, and respective heaters are structured in such a manner that their lighting conditions are independently on-off controlled.

As described above, a reason why a plurality of heaters are provided, is as follows: for example, irrespective of the difference of sizes of the image supporter, it becomes possible that the temperature distribution of the fixing heating roller becomes uniform in a predetermined temperature range (hereinafter, called specified temperature range), and the rise time of the temperature of the fixing heating roller is reduced.

(The First Problem)

However, in the fixing device as described above, when a plurality of heaters are lighted, the rush current flows into a lighting circuit of the heater simultaneously when these heaters are lighted. By this rush current, voltage variation is generated in an electric lamp line to which the image forming apparatus is connected.

As a result of such occurrence of the voltage variation in the electric lamp line, there is a problem that flicker (i.e., a sense of flickering) is generated in illumination devices connected to the power line in common with the image forming apparatus, and it is necessary that the degree of this flicker is suppressed in a regulated manner (flicker regulation). For example, in the image forming apparatus, the flicker value (short time flicker value) during the copying operation regulated by the voltage variation amount, is regulated to not more than 1, and the flicker value in the stand-by (long time flicker value) regulated by the generation frequency of the voltage variation is regulated to not more than 0.65.

In this connection, in the fixing device as described above, it is found that both of the short time flicker value and long time flicker value are not suppressed in the regulated range. This problem prominently appears when a heater whose output power is specially high is used.

That is, in the fixing device as described above, when heaters which are turned off, are lighted in the parallel condition, large rush current is generated in the heater lighting circuit, thereby, there is a problem that a bad influence is affected on other devices constituting the image forming apparatus.

Accordingly, in the heater lighting circuit structured by electrically connecting a plurality of heaters to a common AC power source through a plurality of switch elements, it can be considered that each heater is in a parallel connection condition at the time of use, but at the time of lighting, each heater is in a serial connection condition, however, the condition at which condition the connection condition may be switched is not considered.

(The Second Problem)

Further, in the heater lighting circuit structured by electrically connecting a plurality of heaters to a common AC power source through a plurality of switch elements as described above, in the heater lighting circuit structured in such a manner that each heater is in parallel connection condition at the time of use, but at the time of lighting, each heater is in a serial connection condition once, and is switched to a parallel connection condition, when the connection condition of the heater is switched, for example, from the serial connection condition to the parallel connection condition, because the switching of condition of each switch element is simultaneously conducted, a short circuit is formed by the switch element which is turned on to the AC power source, and there is a possibility that a dead short is generated.

In such case, the control in which all switch elements are simultaneously turned off for a predetermined time, is also considered, however, the control becomes complicated, and further, it is forecasted that the problem in which the temperature of the heater is lowered due to the off period, is also generated.

SUMMARY OF THE INVENTION

The present invention is attained in order to solve the first problem as described above, and the object of the present invention is to provide a heater control apparatus and an image forming apparatus, by which the excessive current generated when a plurality of heaters are lighted is suppressed, and the flicker generated in other illumination devices connected to the power line common to the heater can be suppressed.

Further, the present invention is attained in order to solve the second problem as described above, and the object of the present invention is, in the case where a plurality of heaters which can be switched between the serial connection condition and the parallel connection condition are provided, to provide a heater control apparatus and an image forming apparatus whose operation has high reliability, by preventing the destruction of switching elements due to a dead short when the connection condition of a plurality of heaters is switched.

Accordingly, to overcome the cited shortcomings, the abovementioned object of the present invention can be attained by heater control apparatus and image-forming apparatus described as follow.

(1) A heater control apparatus for controlling a plurality of heaters, each of which is incorporated in an interior of each of rollers, comprising: a plurality of switching elements to switch flowing paths of electronic currents supplied to the heaters from a common power source; a switching control section to control the switching elements so that a connecting mode of the heaters is changeable between a serial connection mode and a parallel connection mode; and a plurality of temperature detecting devices to detect temperatures of the rollers heated by the heaters, each of the temperature detecting devices corresponding to each of the rollers; wherein, when one of the heaters, incorporated in one of the rollers, is turned on, under a condition that temperatures of other rollers are maintained in a predetermined range, the switching control section controls the switching elements so that the connecting mode of the heaters is changed to the serial connection mode before flowing electronic current into the heaters, and under a condition that temperatures of other rollers are lower than a lowest temperature of the predetermined range, the switching control section controls the switching elements so that the connecting mode of the heaters is changed to the parallel connection mode before flowing electronic current into the heaters, and under a condition that temperatures of other rollers exceed a highest temperature of the predetermined range, the switching control section controls the switching elements so that the one of the heaters is independently turned on.

(2) An image-forming apparatus, which conducts heater-controlling operations for controlling a plurality of heaters, each of which is incorporated in an interior of each of rollers, comprising: a plurality of switching elements to switch flowing paths of electronic currents supplied to the heaters from a common power source; a switching control section to control the switching elements so that a connecting mode of the heaters is changeable between a serial connection mode and a parallel connection mode; and a plurality of temperature detecting devices to detect temperatures of the rollers heated by the heaters, each of the temperature detecting devices corresponding to each of the rollers; wherein, when one of the heaters, incorporated in one of the rollers, is turned on, under a condition that temperatures of other rollers are maintained in a predetermined range, the switching control section controls the switching elements so that the connecting mode of the heaters is changed to the serial connection mode before flowing electronic current into the heaters, and under a condition that temperatures of other rollers are lower than a lowest temperature of the predetermined range, the switching control section controls the switching elements so that the connecting mode of the heaters is changed to the parallel connection mode before flowing electronic current into the heaters, and under a condition that temperatures of other rollers exceed a highest temperature of the predetermined range, the switching control section controls the switching elements so that the one of the heaters is independently turned on.

(3) A heater control apparatus for controlling a plurality of heaters, each of which is incorporated in an interior of each of rollers, comprising: a plurality of switching elements to switch flowing paths of electronic currents supplied to the heaters from a common power source; a switching control section to control the switching elements so that a connecting mode of the heaters is changeable between a serial connection mode and a parallel connection mode; and a rush-current limiting element, coupled into anyone of the flowing paths, to limit a rush-current generated by a short circuit, which would be possibly formed depending on a switching status of the switching elements.

(4) The heater control apparatus of item 3, wherein the rush-current limiting element is a register.

(5) An image-forming apparatus, which conducts heater-controlling operations for controlling a plurality of heaters, each of which is incorporated in an interior of each of rollers, comprising: a plurality of switching elements to switch flowing paths of electronic currents supplied to the heaters from a common power source; a switching control section to control the switching elements so that a connecting mode of the heaters is changeable between a serial connection mode and a parallel connection mode; and a rush-current limiting element, coupled into anyone of the flowing paths, to limit a rush-current generated by a short circuit, which would be possibly formed depending on a switching status of the switching elements.

(6) The image-forming apparatus of item 5, wherein the rush-current limiting element is a register.

(7) The heater control apparatus of item 1, further comprising: a rush-current limiting element, coupled into anyone of the flowing paths, to limit a rush-current generated by a short circuit, which would be possibly formed depending on a switching status of the switching elements.

(8) The heater control apparatus of item 7, wherein the rush-current limiting element is a register.

(9) An image-forming apparatus, which conducts heater-controlling operations for controlling a plurality of heaters, each of which is incorporated in an interior of each of rollers, comprising: a plurality of switching elements to switch flowing paths of electronic currents supplied to the heaters from a common power source; a switching control section to control the switching elements so that a connecting mode of the heaters is changeable between a serial connection mode and a parallel connection mode; a plurality of temperature detecting devices to detect temperatures of the rollers heated by the heaters, each of the temperature detecting devices corresponding to each of the rollers; and a rush-current limiting element, coupled into anyone of the flowing paths, to limit a rush-current generated by a short circuit, which would be possibly formed depending on a switching status of the switching elements; wherein, when one of the heaters, incorporated in one of the rollers, is turned on, under a condition that temperatures of other rollers are maintained in a predetermined range, the switching control section controls the switching elements so that the connecting mode of the heaters is changed to the serial connection mode before flowing electronic current into the heaters, and under a condition that temperatures of other rollers are lower than a lowest temperature of the predetermined range, the switching control section controls the switching elements so that the connecting mode of the heaters is changed to the parallel connection mode before flowing electronic current into the heaters, and under a condition that temperatures of other rollers exceed a highest temperature of the predetermined range, the switching control section controls the switching elements so that the one of the heaters is independently turned on.

(10) The image-forming apparatus of item 9, wherein the rush-current limiting element is a register.

Further, to overcome the abovementioned problems, other image-recording apparatus, embodied in the present invention, will be described as follow:

(11) A heater control apparatus, characterized in that, in the heater control apparatus which is provided with: a plurality of switch elements to switch the supply of the electric power from a common power source; a plurality of heaters which are connected to the common power source through the plurality of switch elements, and respectively housed in rollers; a switching control means for controlling so that, by controlling a condition of each switch element, the plurality of heaters can be switched between the serial connection condition and parallel connection condition; and a temperature detecting means for detecting the temperature of rollers heated by each heater, in the case where one heater is tried to be lighted, the switching control means controls such that, when the temperature of a roller heated by the other heater is in a predetermined temperature range, one heater is serially connected to the other heater, and lighted, and when the temperature of a roller heated by the other heater is not higher than a predetermined temperature range, the one heater is parallelly connected with the other heater, and lighted, and when the temperature of the roller heated by the other heater exceeds the predetermined temperature range, the one heater is independently lighted.

(12) An image forming apparatus, characterized in that, in the image forming apparatus, conducting the heater control, which is provided with: a plurality of switch elements to switch the supply of the electric power from a common power source; a plurality of heaters which are connected to the common power source through the plurality of switch elements, and respectively housed in rollers; a switching control means for controlling so that, by controlling a condition of each switch element, the plurality of heaters can be switched between the serial connection condition and parallel connection condition; and a temperature detecting means for detecting the temperature of rollers heated by each heater, in the case where one heater is tried to be lighted, the switching control means controls such that, when the temperature of a roller heated by the other heater is in a predetermined temperature range, one heater is serially connected to the other heater, and lighted, and when the temperature of a roller heated by the other heater is not higher than a predetermined temperature range, the one heater is parallelly connected with the other heater, and lighted, and when the temperature of the roller heated by the other heater exceeds the predetermined temperature range, the one heater is independently lighted.

In these inventions, in the case where one heater is tried to be lighted, (a) when the temperature of a roller heated by the other heater is in a predetermined specified temperature range, one heater is controlled in such a manner that it is serially connected to the other heater and lighted, (b) when the temperature of a roller heated by the other heater is not higher than a predetermined specified temperature range, the one heater is controlled such that it is parallelly connected with the other heater, and lighted, and, (c) when the temperature of the roller heated by the other heater exceeds the predetermined specified temperature range, it is controlled in such a manner that the one heater is not connected to the other heater and only the one heater is lighted.

When conducted as described above, when a plurality of heaters are lighted in the case of (a), the resistance value is increased by the serial connection, and even when the heater in which the temperature is low and the resistance value is small, is lighted, the rush current is reduced. That is, the generated excessive current is suppressed and the flickers generated in other illumination devices connected to the power line in common with the heaters can be suppressed. Further, in the case of (b), in order to dissolve the low temperature condition, the temperature rise is accelerated by the parallel connection. Further, in the case of (c), the lighting of the other heater is not necessary and only the one heater copes with the condition.

That is, the generated excessive current is suppressed, and the flickers generated in other illumination devices connected to the power line in common with the heaters can be suppressed.

(2) A heater control apparatus, characterized in that, the heater control apparatus is provided with: a plurality of switch elements to switch the supply of the electric power from a common power source; a plurality of heaters which are connected to the common power source through the plurality of switch elements, and respectively housed in rollers; a switching control means for controlling so that, by controlling a condition of each switch element, the plurality of heaters can be switched between the serial connection condition and parallel connection condition; and a large current limit element arranged in any position in the path forming the short circuit to the AC power source, corresponding to conditions of the plurality of switch elements.

(14) An image forming apparatus, characterized in that, the image forming apparatus is provided with: a plurality of switch elements to switch the supply of the electric power from a common power source; a plurality of heaters which are connected to the common power source through the plurality of switch elements, and respectively housed in rollers; a switching control means for controlling so that, by controlling a condition of each switch element, the plurality of heaters can be switched between the serial connection condition and parallel connection condition; and a large current limit element arranged in any position in the path forming the short circuit to the AC power source, corresponding to conditions of the plurality of switch elements.

In this connection, it is preferable that the large current limit element in the above case, is a resistor.

In these inventions, because the large current limit element is arranged in any position in the path forming the short circuit to the AC power source, corresponding to conditions of the plurality of switch elements, in the case where a plurality of heaters which can be switched between the serial connection condition and the parallel connection condition, are provided, when connection conditions of the plurality of heaters are switched, even when the short circuit is formed, the destruction of the switch element due to the dead short is prevented. Accordingly, the heater control apparatus and the image forming apparatus, in which the reliability of operations is high, can be realized.

Further, when the resistor is used for the large current limit element, the complicated switch control or high cost element is not used, and the apparatus in which the desired object is attained by a simple structure and in the low cost, can be structured.

(15) A heater control apparatus, characterized in that, in the heater control apparatus, which is provided with: a plurality of switch elements to switch the supply of the electric power from a common power source; a plurality of h eaters which are connected to the common power source through the plurality of switch elements, and respectively housed in rollers; a switching control means for controlling so that, by controlling a condition of each switch element, the plurality of heaters can be switched between the serial connection condition and parallel connection condition; and a large current limit element arranged in any position in the path forming the short circuit to the AC power source, corresponding to conditions of the plurality of switch elements, in the case where one heater is tried to be lighted, the switching control means controls such that, when the temperature of a roller heated by the other heater is in a predetermined temperature range, one heater is serially connected to the other heater, and lighted, and when the temperature of a roller heated by the other heater is not higher than a predetermined temperature range, the one heater is parallelly connected with the other heater, and lighted, and when the temperature of the roller heated by the other heater exceeds the predetermined temperature range, the one heater is independently lighted.

(16) An image forming apparatus, characterized in that, in the image forming apparatus, which is provided with: a plurality of switch elements to switch the supply of the electric power from a common power source; a plurality of heaters which are connected to the common power source through the plurality of switch elements, and respectively housed in rollers; a switching control means for controlling so that, by controlling a condition of each switch element, the plurality of heaters can be switched between the serial connection condition and parallel connection condition; and a large current limit element arranged in any position in the path forming the short circuit to the AC power source, corresponding to conditions of the plurality of switch elements, in the case where one heater is tried to be lighted, the switching control means controls such that, when the temperature of a roller heated by the other heater is in a predetermined temperature range, one heater is serially connected to the other heater, and lighted, and when the temperature of a roller heated by the other heater is not higher than a predetermined temperature range, the one heater is parallelly connected with the other heater, and lighted, and when the temperature of the roller heated by the other heater exceeds the predetermined temperature range, the one heater is independently lighted.

In this connection, it is preferable that the large current limit element is a resistor.

In these inventions, in the case where one heater is tried to be lighted, (a) when the temperature of a roller heated by the other heater is in a predetermined specified temperature range, one heater is controlled in such a manner that it is serially connected to the other heater and lighted, (b) when the temperature of a roller heated by the other heater is not higher than a predetermined specified temperature range, the one heater is controlled such that it is parallelly connected with the other heater, and lighted, and, (c) when the temperature of the roller heated by the other heater exceeds the predetermined specified temperature range, it is controlled in such a manner that the one heater is not connected to the other heater and only the one heater is lighted.

When conducted as described above, when a plurality of heaters are lighted in the case of (a), the resistance value is increased by the serial connection, and even when the temperature is low and the resistance value turns on the heater, the rush current is reduced. That is, the generated excessive current is suppressed and the flickers generated in other illumination devices connected to the power line in common with the heaters can be suppressed. Further, in the case of (b), in order to dissolve the low temperature condition, the temperature rise is accelerated by the parallel connection. Further, in the case of (c), the lighting of the other heater is not necessary and only the one heater copes with the condition.

Then, in these inventions, because the large current limit element is arranged in any position in the path forming the short circuit to the AC power source, corresponding to conditions of the plurality of switch elements, in the case where a plurality of heaters which can be switched between the serial connection condition and the parallel connection condition, are provided, when connection conditions of the plurality of heaters are switched, even when the short circuit is formed, the destruction of the switch element due to the dead short is prevented. Accordingly, the heater control apparatus and the image forming apparatus, in which the reliability of operations is high, can be realized.

Further, when the resistor is used for the large current limit element, the complicated switch control or high cost element is not used, and the apparatus in which the desired object is attained by a simple structure and in the low cost, can be structured.

BRIEF DESCRIPTION OF THE DRAWINGS

Other objects and advantages of the present invention will become apparent upon reading the following detailed description and upon reference to the drawings in which:

FIG. 8(*a*), FIG. 8(*b*) and FIG. 8(*c*) are circuit structural views showing examples of connection conditions of the heaters in the heater control apparatus of the second embodiment of the present invention.

DETAILED DESCRIPTION OF THE PREFERRED EMBODIMENT

Figure 1:
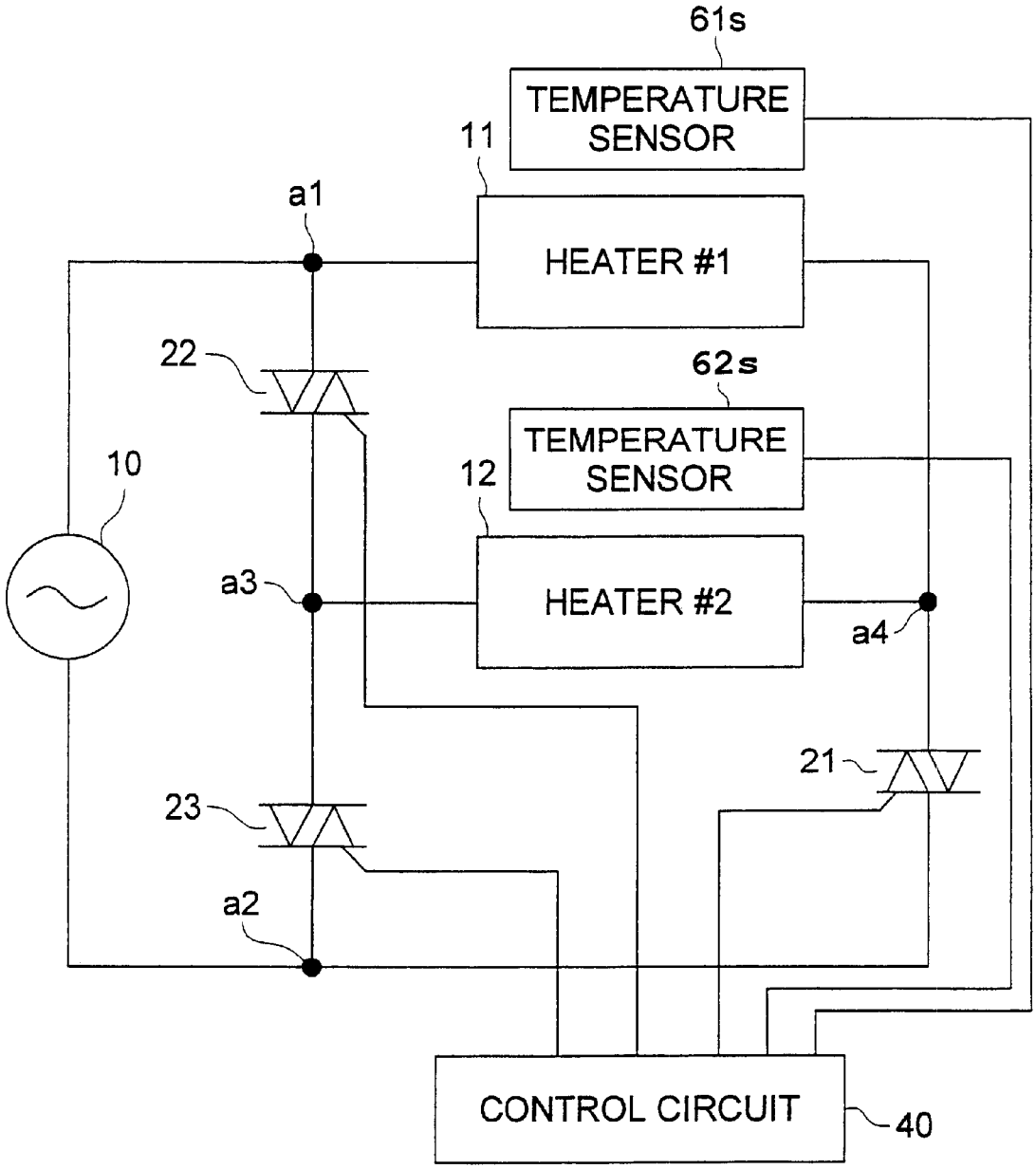
FIG. 1 is a circuit structural view showing an example of a heater lighting circuit in a heater control apparatus of the first embodiment of the present invention.

Referring to the drawings, the embodiments of the present invention will be detailed below.

(The First Embodiment)

FIG. 1 is a circuit structural view showing the first embodiment of the heater lighting circuit in the heater control apparatus of the present invention.

This heater lighting circuit is structured in such a manner that a main heater (heater #1) 11 and a sub-heater (heater #2) 12 are connected to a common AC power source 10 suplied from, for example, a commercial power supply through 3 switch elements 21, 22, and 23.

Specifically, initially, the main heater 11 and the switch element 21 are serially connected to the AC power source 10. Then, a serial circuit of the switch element 22 and the switch element 23 is connected between a connection point a1 of the AC power source 10 and the main heater 11, and a connection point a2 of the switch element 21 and the AC power source 10. Further, the sub-heater 12 is connected between a connection point a3 of the switch element 22 and the switch element 23, and a connection point a4 of the main heater 11 and the switch element 21.

Further, the 3 switching elements 21 to 23 are structured in such a manner that on/off is switched by a control signal from a control terminal, and the control signal from a control circuit 40 is supplied to the control terminal of each switching element. That is, each of switch elements 21 to 23 is, for example, composed of a switch element with a control terminal such as TRIAC, and is independently controlled in such a manner that each of them operates in an on-condition or an off-condition in accordance with the control signal.

The switch element is not limited to the TRIAC, and other elements may be used. Further, the control circuit 40 may be an exclusive switching control means for controlling the switch element, or may be a CPU to control the whole of the image forming apparatus.

Further, the main heater 11 and sub-heater 12 are composed of heater lamps such as, for example, halogen incandescent lamps, and in this heater lighting circuit, the turning-on and turning-off of the main heater 11 and sub-heater 12 are controlled by the control circuit 40.

Figure 2:
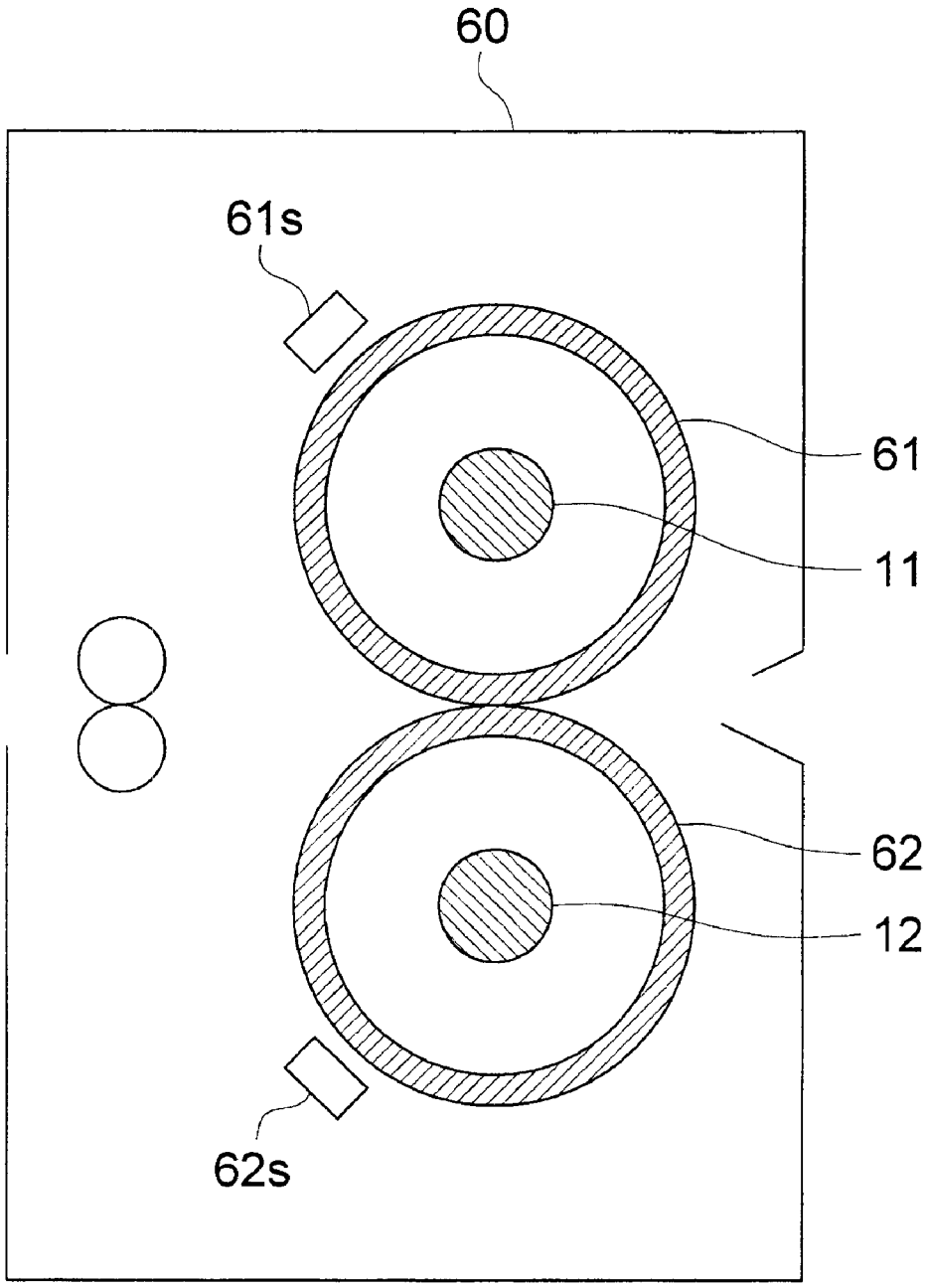
FIG. 2 is a structural view showing the structure of a main portion of an image forming apparatus of the first embodiment of the present invention.

The heating objects of heaters 11 and 12 are, as shown in FIG. 2, the same kind of heated bodies, for example, fixing heating rollers 61 and 62 which are opposite to each other, in the fixing section 60 of the image forming apparatus. In this connection, the explanation of the well known component portions as the image forming apparatus, for example, the portion in which an electrostatic latent image is formed on the photoreceptor drum, and this electrostatic latent image is developed, and transferred onto a transfer sheet, is neglected.

In this case, as the main heater 11, a heater in which the output power is, for example, 900 w, and as the sub-heater 12, a heater in which the output power is, for example, 300 w, are used.

In this connection, a temperature sensor 61*s* is arranged in the vicinity of the fixing heating roller 61 which is heated by the main heater 11, and a temperature sensor 62*s* is arranged in the vicinity of the fixing heating roller 62 which is heated by the sub-heater 12.

Figure 3:
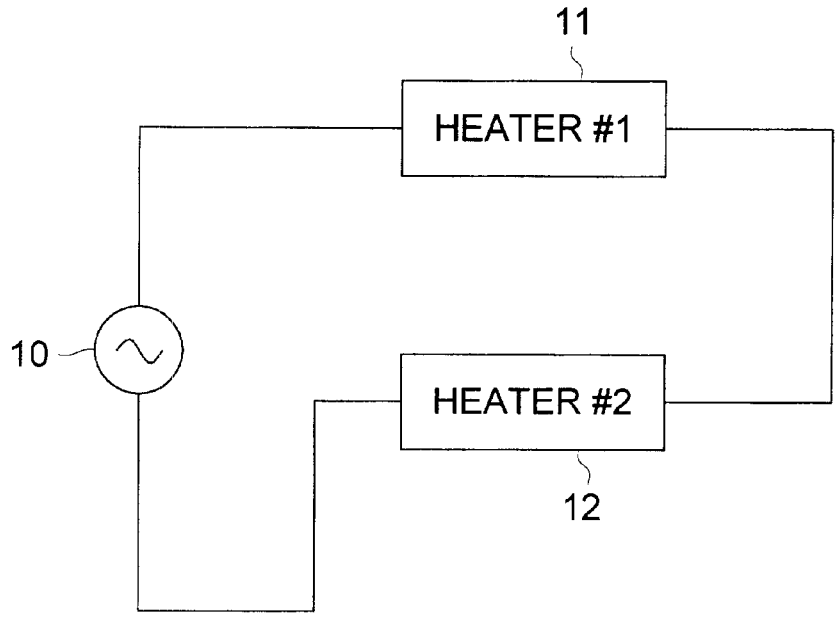
FIG. 3(*a*) and FIG. 3(*b*) are circuit structural views showing examples of connection conditions of heaters in the heater control apparatus of the first embodiment of the present invention.
Figure 3:
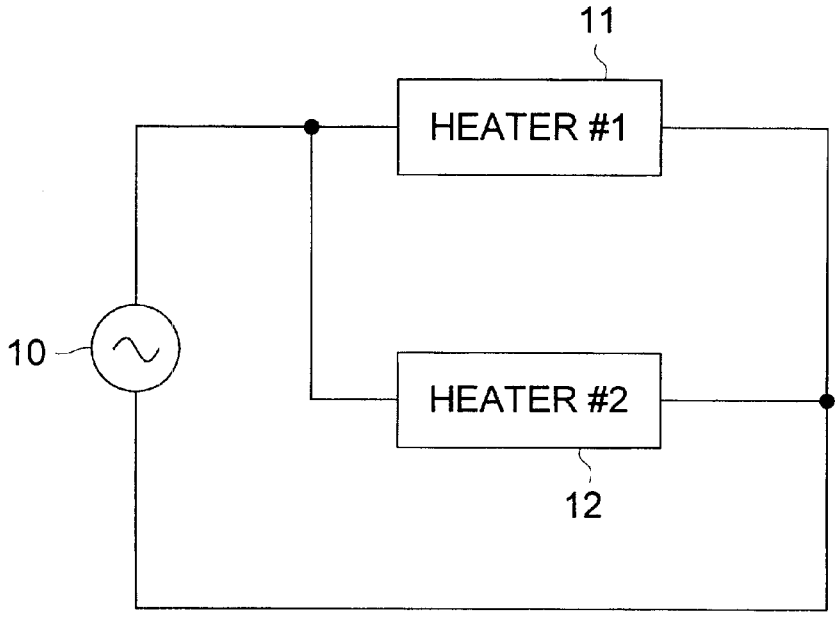

In this heater lighting circuit, when both of the switch element 21 and switch element 22 are in an off-condition, and the switch element 23 is in an on-condition, both of the main heater 11 and sub-heater 12 are in the serial connection condition (refer to FIG. 3(*a*)). Further, when both of the switch element 21 and switch element 22 are in the on-condition, and the switch element 23 is in the off-condition, both of the main heater 11 and sub-heater 12 are in the parallel connection condition (refer to FIG. 3(*b*)).

That is, in the heater lighting circuit as described above, the control circuit 40 is structured so as to control the condition of each switch according to the temperature data signal from the temperature sensors 61*s* and 62*s* to detect the temperature of heated bodies.

In such the heater control apparatus, corresponding to the condition after the main power source of the image forming apparatus is turned on, the main heater 11 and sub-heater 12 are respectively independently controlled in various modes. For example, in the operation of the heated bodies, in the mode in which both of the main heater 11 and sub-heater 12 are turned on or turned off, or either one of the main heater 11 and sub-heater 12 is turned on or turned off, the main heater 11 and sub-heater 12 are on/off controlled, corresponding to the temperature of the heated bodies detected by the temperature sensors, so that the temperature of the heated bodies is maintained within the specified temperature range.

In this connection, it is preferable that the specified temperature range of the fixing heating roller in this heater control apparatus is the range of, for example, 1 to 5° C. including the setting temperature T1.

The operation of in the heater control apparatus or image forming apparatus of the present embodiment structured as described above, will be described below.

Figure 4:
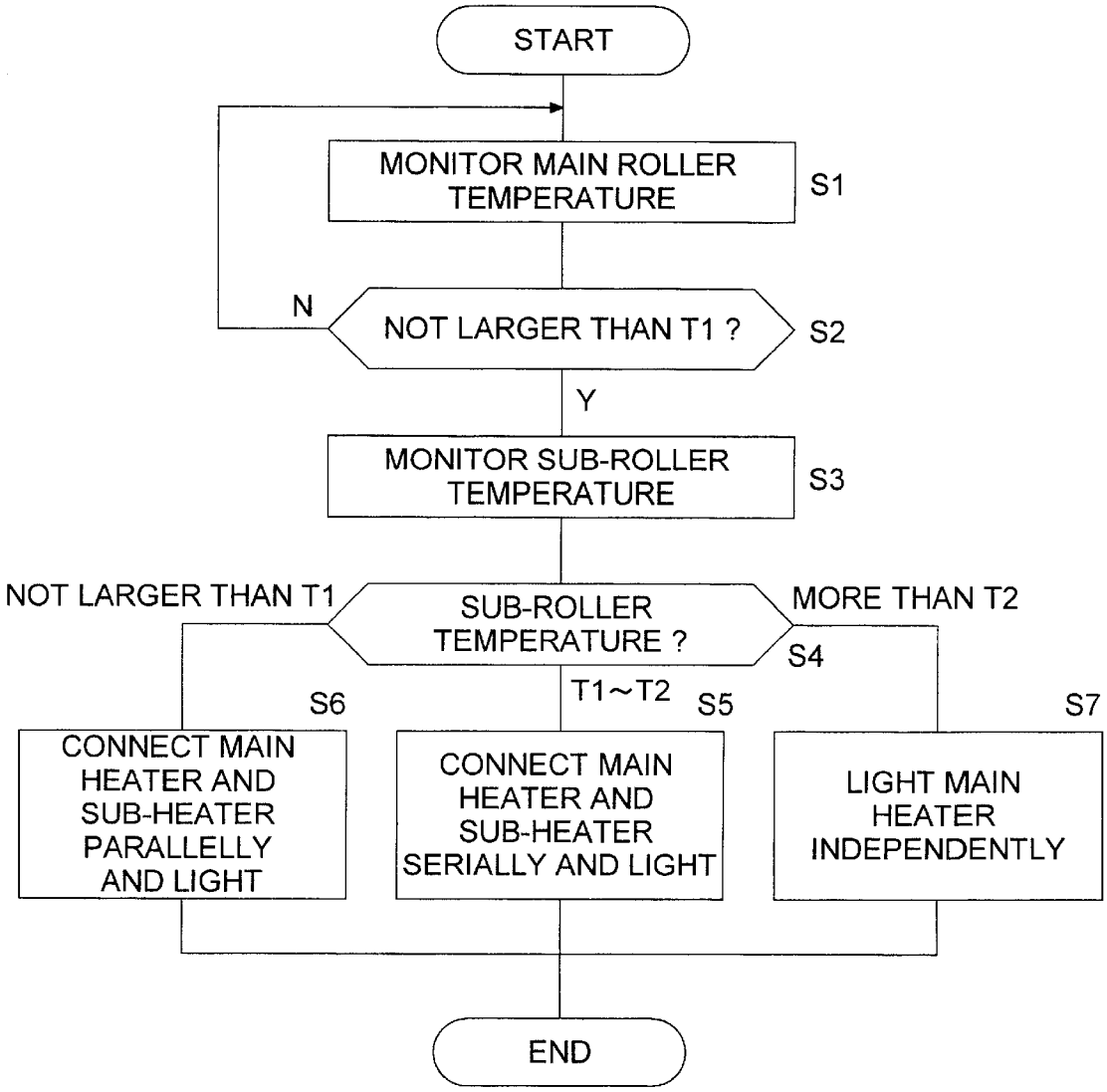
FIG. 4 is a flow chart explaining operation conditions of the first embodiment of the present invention.
Figure 5:
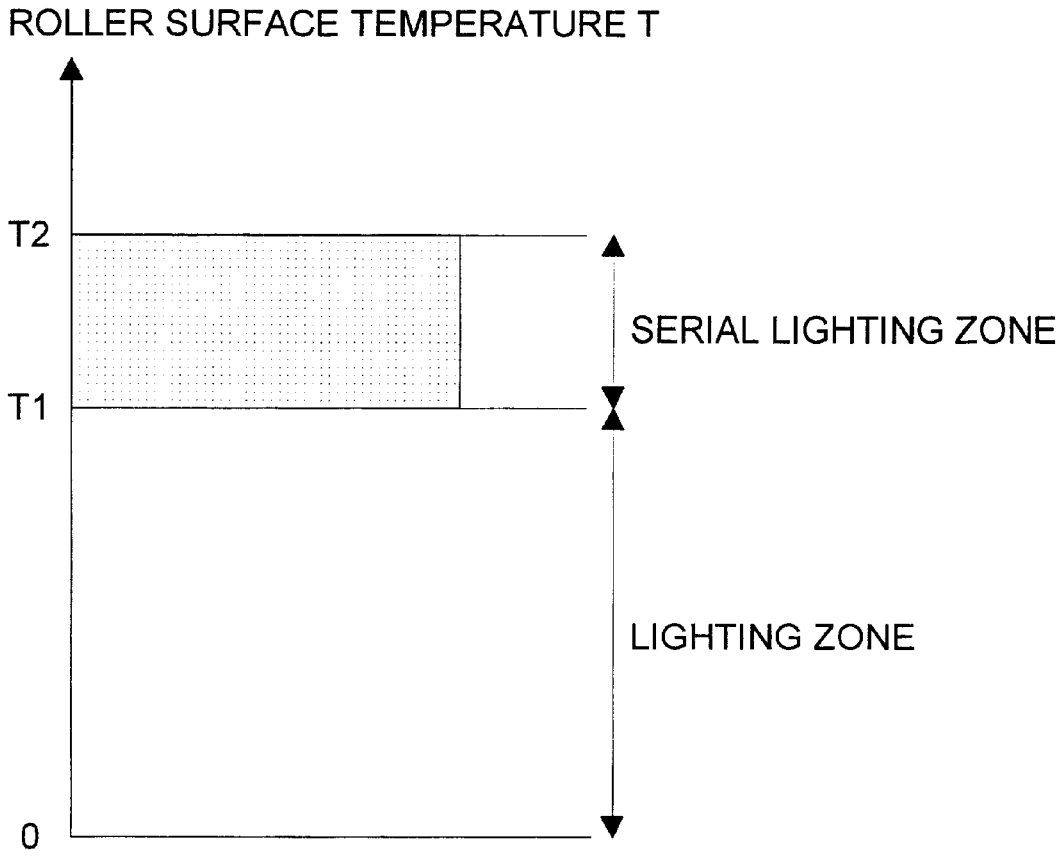
FIG. 5 is an illustration relating to the heater control of the first embodiment of the present invention.

Initially, the control circuit 40 monitors the surface temperature of the fixing heating roller (main roller) 61 heated by the main heater 11 corresponding to the necessity when the main power source of the image forming apparatus is turned on or the image is formed, by the temperature sensor 61*s* (FIG. 4, S1). In this connection, the control circuit 40 controls so that the surface temperature of the fixing heating roller 61 is within the specified temperature range (T1–T2 in FIG. 5), by the on/off control of the main heater 11.

When the surface temperature of the fixing heating roller 61 is not larger than the lower limit T1 of the specified temperature range due to any reason (YES in FIG. 4, S2), both of the main heater 11 and the sub-heater 12, or only one of the main heater 11, are turned on so that the temperature lowering is prevented, and the control circuit 40 conducts the following control.

Herein, the control circuit 40 monitors the surface temperature of the fixing heating roller (sub-roller) 62 heated by the sub-heater 12, by the temperature sensor 62*s* (S3 and S4 in FIG. 4).

By this temperature monitoring, (1) When the temperature of the fixing heating roller 62 is within the predetermined range (T1–T2), the main heater 11 and sub-heater 12 are controlled so that, after these are serially connected, these are lighted (FIG. 4, S5).

(2) When the temperature of the fixing heating roller 62 is not larger than the predetermined specified temperature range (not larger than T1), the main heater 11 and sub-heater 12 are controlled so that, after these are parallely connected, these are lighted (FIG. 4, S6).

(3) When the temperature of the fixing heating roller 62 exceeds the predetermined specified temperature range (T2), the sub-heater 12 is not lighted, and the main heater 11 is controlled so that only the main heater 11 is independently lighted (FIG. 4, S7).

When conducted as described above, when a plurality of heaters are lighted in the case of (1), the resistance value is increased by the serial connection, and even when the sub-heater 12 in which the temperature is low and the resistance value is small, is lighted, the rush current is reduced. That is, the generated excessive current is suppressed and the flickers generated in other illumination devices connected to the power line in common with the heaters can be suppressed. Further, in the case of (2), in order to dissolve the low temperature condition, the temperature rise is accelerated by the parallel connection. Further, in the case of (3), the lighting of the sub-heater 12 is not necessary and only the main heater 11 copes with the condition.

In this connection, when the main heater 11 and sub-heater 12 which are serially connected in (1), are switched from the serial connection to the parallel connection after a predetermined time has passed, the sufficient heating can be conducted. When it is after the lapse of the predetermined time, because the heater is fully heated and the resistance value is sufficiently increased, even when the connection is switched to the parallel connection condition, the flicker is reduced.

(The Second Embodiment)

Figure 6:
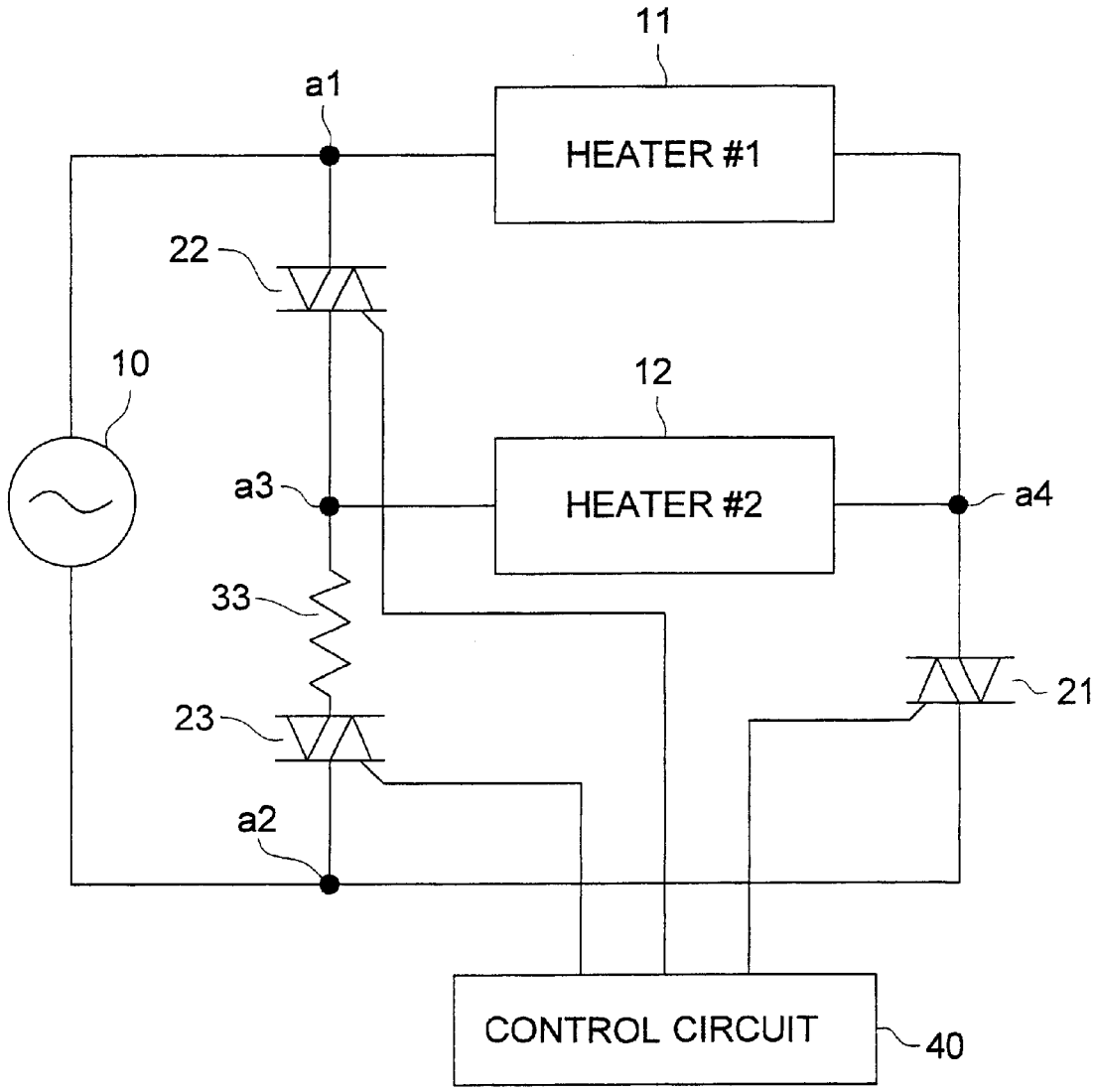
FIG. 6 is a circuit structural view showing an example of the heater lighting circuit in the heater control apparatus of the second embodiment of the present invention.

FIG. 6 is a circuit structural view showing the second embodiment of a heater lighting circuit in a heater control apparatus of the present invention. The same number is denoted onto the same parts in FIG. 1 which is already described.

This heater lighting circuit is structured in such a manner that a main heater (heater #1) 11 and a sub-heater (heater #2) 12 are connected to a common AC power source 10 supplied from, for example, a commercial power supply through 3 switch elements 21, 22, and 23.

Specifically, initially, the main heater 11 and the switch element 21 are serially connected to the AC power source 10. Then, a serial circuit of the switch element 22, the resistor 33 as a large current limit element and the switch element 23 is connected between a connection point a1 of the AC power source 10 and the main heater 11, and a connection point a2 of the switch element 21 and the AC power source 10. Further, the sub-heater 12 is connected between a connection point a3 of the switch element 22 and the resistor 33, and a connection point a4 of the main heater 11 and the switch element 21.

Further, the 3 switching elements 21 to 23 are structured in such a manner that on/off is switched by a control signal from a control terminal, and the control signal from a control circuit 40 is supplied to the control terminal of each switching element. That is, each of switch elements 21 to 23 is, for example, composed of a switch element with a control terminal such as TRIAC, and is independently controlled in such a manner that each of them operates in an on-condition or an off-condition in accordance with the control signal.

Further, the main heater 11 and sub-heater 12 are composed of heater lamps such as, for example, halogen incandescent lamps, and in this heater lighting circuit, the turning-on and turning-off of the main heater 11 and sub-heater 12 are controlled by the control circuit 40.

The heating object of these heaters 11 and 12 is the same kind of heated body (for example, fixing heating rollers 61 and 62 which are opposite to each other, in the fixing section 60 of the image forming apparatus) as shown in FIG. 2, which is the same as in the first embodiment.

Figure 7:
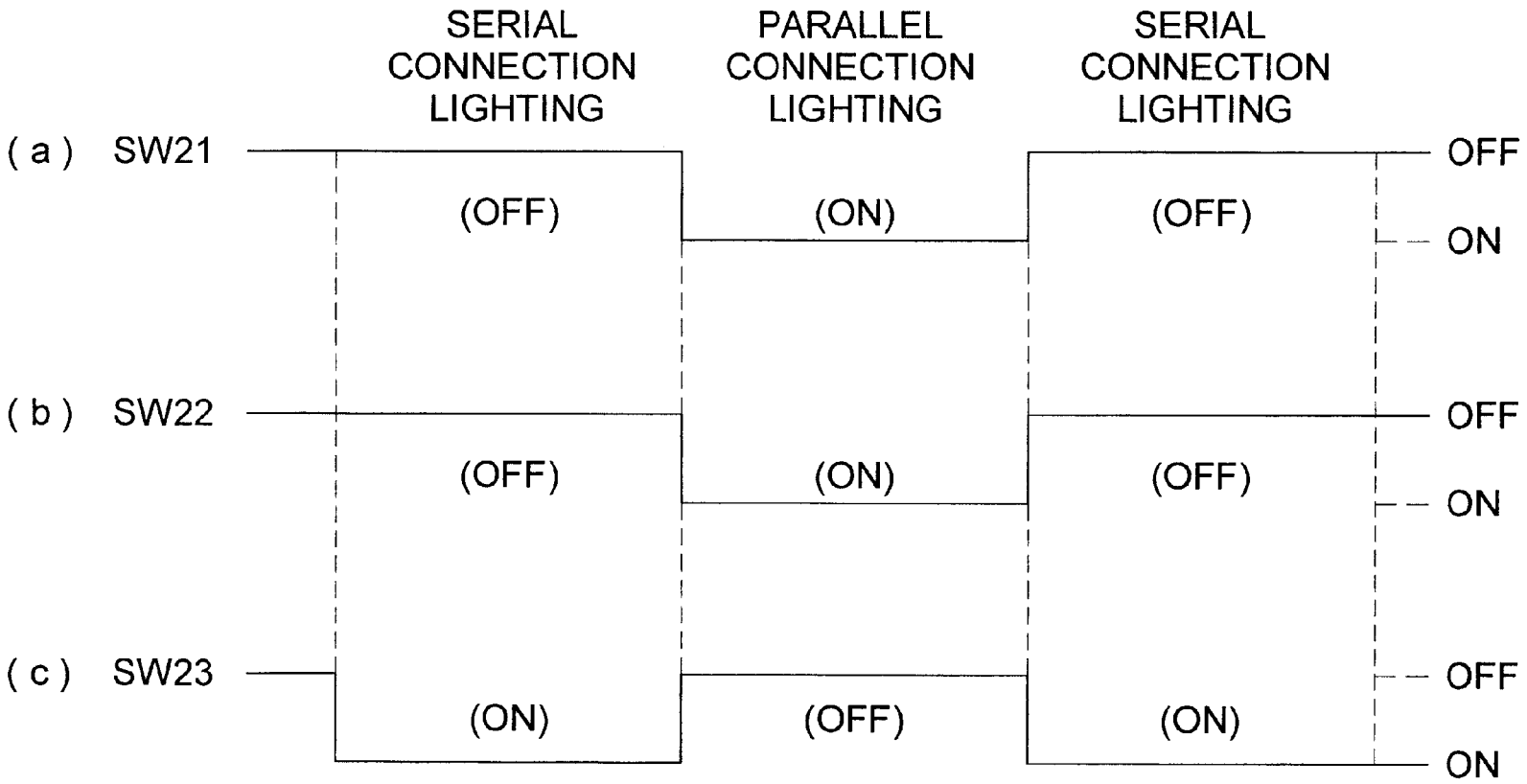
FIG. 7 is a time chart for explaining a operation condition of the second embodiment of the present invention.

In this heater lighting circuit, when both of the switch element 21 and switch element 22 are in an off-condition, and the switch element 23 is in an on-condition (refer to FIG. 7), the main heater 11 and sub-heater 12 and resistor 33 are in the serial connection condition. Further, when both of the switch element 21 and switch element 22 are in the on-condition, and the switch element 23 is in the off-condition (refer to FIG. 7), both of the main heater 11 and sub-heater 12 are in the parallel connection condition as shown in FIG. 8(*b*). In this manner, when the lighting is conducted by switching in the manner of the serial connection condition—parallel connection condition—serial connection condition, the rush current at the time of turning-on and turning-off can be suppressed to be small.

In this connection, at the timing of switching from the serial connection condition to the parallel connection condition, and at the instant of switching from the parallel connection condition to the serial connection condition, there is a case in which an on-time of the switch element 22 and an on-time of the switch element 23 are overlapped. In that case, the switch element 22 and the switch element 23 structure the short circuit to the power source 10. Therefore, conventionally, the dead short is caused and the large current flowed. However, in the present embodiment, because the resistor 33 as the large current limit element is arranged in any position in the path forming the short circuit to the AC power source, in the case where a plurality of heaters which can be switched between the serial connection condition and the parallel connection condition, are provided, when the connection condition of the plurality of heaters is switched, even when the short circuit is formed, the destruction of switch elements due to the dead short is prevented (refer to FIG. 8(*c*)), thereby, the heater control apparatus and the image forming apparatus, in which the reliability of the operation is high, can be realized.

In this connection, conventionally, when the dead short occurs, because the large current flows, the switch element 22 or switch element 23 is destroyed. Herein, when the switch element 22 is destroyed, a plurality of heaters can not be parallelly connected, and the low temperature abnormality is generated and the normal image formation can not be conducted. On the one hand, the switch element 23 is destroyed, the serial connection can not be formed, and it becomes a cause of flickering. In this connection, according to the present embodiment, such disadvantages are dissolved.

Further, when the resistor 33 as the large current limit element is arranged as in the present embodiment, the troublesome control in which all switch elements are simultaneously turned off for a predetermined time period, is not necessary. Further, when the resistor is used for the large current limit element, without using the complicated control of switches or expensive elements, the apparatus by which a desired object is attained by a simple structure at the low cost, can be structured.

(The Third Embodiment)

Figure 9:
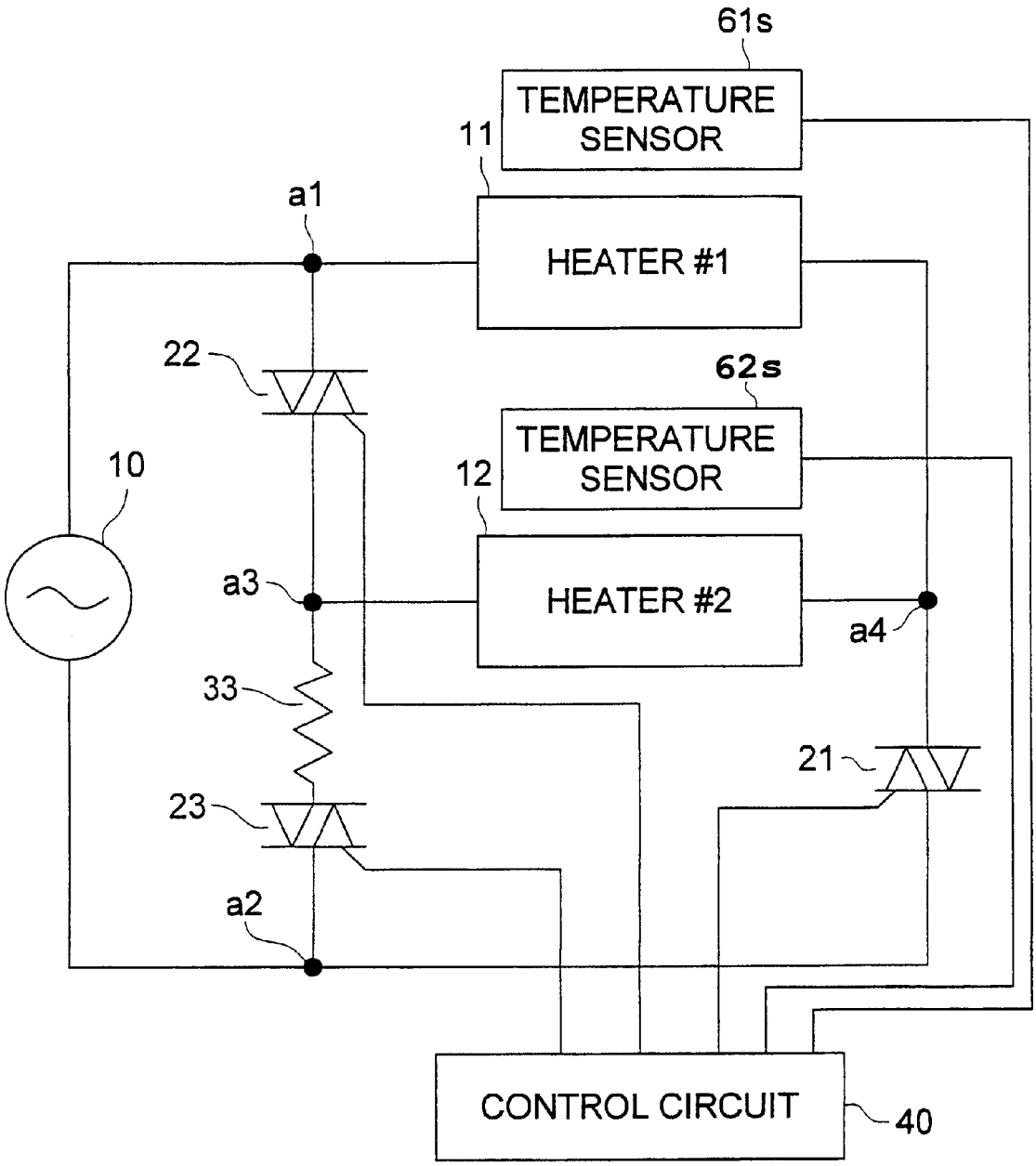
FIG. 9 is a circuit structural view showing an example of the heater lighting circuit in the heater control apparatus of the third embodiment of the present invention.

FIG. 9 is a circuit structural view showing the third embodiment of a heater lighting circuit in a heater control apparatus of the present invention. The same number is denoted onto the same parts in FIG. 1 or FIG. 6 which is already described.

This heater lighting circuit is structured in such a manner that a main heater (heater #1) 11 and a sub-heater (heater #2) 12 are connected to a common AC power source 10 supplied from, for example, a commercial power supply through 3 switch elements 21, Specifically, initially, the main heater 11 and the switch element 21 are serially connected to the AC power source 10. Then, a serial circuit of the switch element 22, the resistor 33 as a large current limit element and the switch element 23 is connected between a connection point a1 of the AC power source 10 and the main heater 11, and a connection point a2 of the switch element 21 and the AC power source 10. Further, the sub-heater 12 is connected between a connection point a3 of the switch element 22 and the resistor 33, and a connection point a4 of the main heater 11 and the switch element 21.

Further, the 3 switching elements 21 to 23 are structured in such a manner that on/off is switched by the control signal from the control terminal, and the control signal from the control circuit 40 is supplied to the control terminal of each switching element. That is, each of switch elements 21 to 23 is composed of a switch element with a control terminal such as, for example, TRIAC, and is independently controlled in such a manner that each of them operates in an on-condition or an off-condition in accordance with the control signal.

The heating object of these heaters 11 and 12 is the same kind of heated body (for example, fixing heating rollers 61 and 62 which are opposite to each other, in the fixing section 60 of the image forming apparatus) as shown in FIG. 2, which is the same as in the first embodiment.

In this connection, a temperature sensor 61*s* is arranged in the vicinity of the fixing heating roller 61 which is heated by the main heater 11, and a temperature sensor 62*s* is arranged in the vicinity of the fixing heating roller 62 which is heated by the sub-heater 12. Then, the control circuit 40 is structured so as to control the condition of each switch element according to the temperature data signal from the temperature sensors 61*s* and 62*s* to detect the temperature of heated bodies.

In such the heater control apparatus, corresponding to the condition after the main power source of the image forming apparatus is turned on, the main heater 11 and sub-heater 12 are respectively independently controlled in various modes. For example, in the operation of the heated bodies, in the mode in which both of the main heater 11 and sub-heater 12 are turned on or turned off, or either one of the main heater 11 and sub-heater 12 is turned on or turned off, the main heater 11 and sub-heater 12 are on/off controlled, corresponding to the temperature of the heated bodies detected by the temperature sensors, so that the temperature of the heated bodies is maintained within the specified temperature range.

As the operation in the heater control apparatus or the image forming apparatus of the present embodiment structured as described above, in the same manner as in the first embodiment described in the flow chart in FIG. 4, by the temperature monitoring:

(1) When the temperature of the fixing heating roller 62 is within the predetermined range (T1–T2), the main heater 11 and sub-heater 12 are controlled so that, after these are serially connected, these are lighted (FIG. 4, S5).

(2) When the temperature of the fixing heating roller 62 is not larger than the predetermined specified temperature range (not larger than T1), the main heater 11 and sub-heater 12 are controlled so that, after these are parallely connected, these are lighted (FIG. 4, S6).

(3) When the temperature of the fixing heating roller 62 exceeds the predetermined specified temperature range (T2), the sub-heater 12 is not lighted, and the main heater 11 is controlled so that only the main heater 11 is independently lighted (FIG. 4, S7).

When conducted as described above, when a plurality of heaters are lighted in the case of (1), the resistance value is increased by the serial connection, and even when the sub-heater 12 in which the temperature is low and the resistance value is small, is lighted, the rush current is reduced. That is, the generated excessive current is suppressed and the flickers generated in other illumination devices connected to the power line in common with the heaters can be suppressed. Further, in the case of (2), in order to dissolve the low temperature condition, the temperature rise is accelerated by the parallel connection. Further, in the case of (3), the lighting of the sub-heater 12 is not necessary and only the main heater 11 copes with the condition. In this connection, when the main heater 11 and sub-heater 12 which are serially connected in (1), are switched from the serial connection to the parallel connection after a predetermined time has passed, the sufficient heating can be conducted. When it is after the lapse of the predetermined time, because the heater is fully heated and the resistance value is sufficiently increased, even when the connection is switched to the parallel connection condition, the flicker is reduced.

Then, in the switching of the serial connection condition and parallel connection condition as described above, the rush current at time of turning-on or turning-off can be suppressed to be small, however, at the timing of switching from the serial connection condition to the parallel connection condition, and at the instant of switching from the parallel connection condition to the serial connection condition, there is a case in which an ontime of the switch element 22 and an on-time of the switch element 23 are overlapped. In that case, the switch element 22 and the switch element 23 structure the short circuit to the power source 10, however, in the present embodiment, because the resistor 33 as the large current limit element is arranged in any position in the path forming the short circuit to the AC power source, even when the short circuit is formed, the destruction of switch elements due to a dead short is prevented by the resistor 33 (refer to FIG. 8(*c*)), thereby, the heater control apparatus and the image forming apparatus, in which the reliability of the operation is high, can be realized.

In this connection, conventionally, when the dead short occurs, because the large current flows, the switch element 22 or switch element 23 is destroyed. Herein, when the switch element 22 is destroyed, a plurality of heaters can not be parallelly connected, and the low temperature abnormality is generated and the normal image formation can not be conducted. On the one hand, when the switch element 23 is destroyed, the serial connection can not be formed, and it becomes a cause of flickering. In this connection, according to the present embodiment, such disadvantages are dissolved.

Further, when the resistor 33 as the large current limit element is arranged as in the present embodiment, the troublesome control in which all switch elements are simultaneously turned off for a predetermined time period, is not necessary. Further, when the resistor is used for the large current limit element, without using the complicated control of switches or expensive elements, the apparatus by which a desired object is attained by a simple structure at the low cost, can be structured.

EXAMPLES

Example 1

The image forming apparatus provided with the fixing device 60 in which 2 halogen incandescent lamps of the main heater 11 whose output power is 900 W and of the sub-heater 12 whose output power is 300 W are respectively provided as heating sources of the fixing heating rollers 61 and 61, is used, and the setting temperature of the fixing heating roller is set to 207° C. and the specified temperature range is set to 205–208° C.

Then, the time period in which the main heater 11 and the sub-heater 12 are held in the serial connection condition, is set to the time period which is necessary so that the temperature of the heating fixing rollers 61 and 62 increases by 1° C. from the temperature of the heating start, and the time period in which the main heater 11 and the sub-heater 12 are held in the serial connection condition, is set to 3 sec, and in the condition in which the main heater 11 and the sub-heater 12 are on/off controlled so that the temperature of the fixing heating rollers 61 and 62 is maintained within the specified temperature range, when the peak value of the rush current flowing when the main heater 11 and the sub-heater 12 are lighted, is measured, the rush current is 24 A.

When the flicker value (short time flicker value) in the copy operation, which is regulated by the voltage variation amount, and the flicker value (long time flicker value) in the stand-by, which is regulated by the occurrence frequency of the voltage variation are measured by using the flicker measuring apparatus (flicker meter), the short time flicker value is 0.88 and the long time flicker value is 0.63, and both satisfy the regulated range.

Comparative Example 1

In the same image forming apparatus as example 1, when the main heater 11 and the sub-heater 12 are lighted not trough the serial connection condition, in the condition in which the main heater 11 and the sub-heater 12 are on/off controlled so that the temperature of the fixing heating rollers 61 and 62 in the fixing device 60 is maintained within the specified temperature range, when the peak value of the rush current flowing when the main heater 11 and the sub-heater 12 are lighted, is measured, the rush current is 55 A.

Further, when the short time flicker value and the long time flicker value are measured, the short time flicker value is 2.0, and the long time flicker value is 1.11, and both do not satisfy the regulated range.

From the above result, when the main heater and the sub-heater are lighted in the parallel connection condition, as the result that the rush current is suppressed when it flows through the serial connection condition, the flicker generated in other illumination devices connected to the power line in common with these heaters can be suppressed, accordingly even when the fixing device having the heater in which the total value of the output power is large, as the heating source, is provided, it can be seen that the present embodiment can satisfy the flicker regulation.

The image forming apparatus provided with the fixing device 60 in which 2 halogen incandescent lamps of the main heater 11 whose output power is 900 W and the sub-heater 12 whose output power is 300 W are provided as heating sources of the fixing heating rollers 61 and 61, and a cement resistor of 1.8Ω (20 W) is used for the resistor 33 as the large current limit element, is used.

Then, the main heater 11 and the sub-heater 12 are set so that they are switched to the serial connection condition and the parallel connection condition, and the main heater 11 and the sub-heater 12 are set so as to be on/off controlled so that the temperature of the fixing heating rollers 61 and 62 of the fixing device 60 is maintained within the specified temperature range.

In this condition, when the peak value of the current flowing when the on-periods of the switch element 22 and the switch element 23 are overlapped is measured, the peak value is 180 A, and is in a safe range. Accordingly, the destruction of the switch element can be prevented. In this connection, in the parallel connection condition of the heaters, the resistance does not entirely affect.

Comparative Example 2

In the same image forming apparatus as in example 2, the main heater 11 and the sub-heater 12 are switched to the serial connection condition and the parallel connection condition, and the current which is so large (because the resistance is almost 0, it is theoretically infinite) that it can not be measured when the on-periods of the switch element 22 and the switch element 23 are overlapped, instantaneously flows, and it departs from the safe range. Therefore, it affects the bad influence on the power source, and the switch element results in destruction.

From the above results, in the case where the main heater and the sub-heater are lighted in the serial connection condition and the parallel connection condition, when the resistor 33 as the large current limit element is arranged, even when the short circuit is formed, the destruction of the switch element due to the dead short can be prevented. Thereby, it can be seen that the heater control apparatus and the image forming apparatus, in which the reliability of the operation is high, can be realized.

According to the present invention as described above, the following effects can be obtained.

(1) When a plurality of heaters are lighted, the resistance value is increased when the heaters are serially connected corresponding to the temperature of the roller, and the rush current is reduced. That is, the generated excessive current is suppressed, and the flicker generated in other illumination devices connected to the power line in common with the heaters can be suppressed.

(2) According to the condition of a plurality of switch elements by which the connection condition of a plurality of heaters is switched, because the large current limit element is arranged in a position in the path forming the short circuit to the AC power source, in the case where a plurality of heaters which can be switched between the serial connection condition and the parallel connection condition, are provided, when the connection condition of the plurality of heaters is switched, even when the short circuit is formed, the destruction of switch elements due to the dead short is prevented. Thereby, the heater control apparatus and the image forming apparatus, in which the reliability of the operation is high, can be realized.

(3) In the case where a plurality of heaters are lighted, when the heaters are serially connected corresponding to the temperature of the roller, the resistance value is increased, and the generated excessive current are suppressed, and the flicker generated in other illumination devices connected to the power line in common with the heaters can be suppressed, and according to the condition of the switch element, by arranging the maximum current limit element in a position of the path forming the short circuit to the AC power source, when the heater is switch between the serial connection condition and the parallel connection condition of the heater, even when the short circuit is formed, the destruction of switch elements due to the dead short is prevented, thereby, the heater control apparatus and the image forming apparatus, in which the reliability of the operation is high, can be realized.

The disclosed embodiments can be varied by a skilled person without departing from the spirit and scope of the invention.

What is claimed is:

1. A heater control apparatus for controlling a plurality of heaters, each of which is incorporated inside one of a plurality of rollers, said heater control apparatus comprising:

a plurality of switching elements to switch flowing paths of electronic currents supplied to said heaters from a common power source;

a switching control section to control said switching elements so that a connecting mode of said heaters is changeable between a serial connection mode and a parallel connection mode; and a short-current limiting element, coupled into anyone of said flowing paths, to limit a short-current flowing from said common power source, caused by a short circuit, which would be possibly formed depending on a switching status of said switching elements.

2. The heater control apparatus of claim 1, wherein said short-current limiting element comprises a resistor.

3. An image-forming apparatus, which conducts heater-controlling operations for controlling a plurality of heaters, each of which is incorporated inside one of a plurality of rollers, said image forming apparatus comprising:

a plurality of switching elements to switch flowing paths of electronic currents supplied to said heaters from a common power source;

a switching control section to control said switching elements so that a connecting mode of said heaters is changeable between a serial connection mode and a parallel connection mode; and a short-current limiting element, coupled into anyone of said flowing paths, to limit a short-current flowing from said common power source, caused by a short circuit, which would be is possibly formed depending on a switching status of said switching elements.

4. The image-forming apparatus of claim 3, wherein said short-current limiting element comprises a resistor.

* * * * *